US008752668B2

(12) United States Patent
Liggett et al.

(10) Patent No.: US 8,752,668 B2
(45) Date of Patent: Jun. 17, 2014

(54) TRACK WITH STOPPING MEANS

(76) Inventors: James Liggett, Martin, MI (US); Tim Powers, Caledonia, MI (US); Troy Garland, Hamilton, MI (US)

( * ) Notice: Subject to any disclaimer, the term of this patent is extended or adjusted under 35 U.S.C. 154(b) by 0 days.

(21) Appl. No.: 13/411,582

(22) Filed: Mar. 4, 2012

(65) Prior Publication Data

US 2013/0228092 A1 Sep. 5, 2013

(51) Int. Cl.
*E01B 25/22* (2006.01)

(52) U.S. Cl.
USPC ..... 182/36; 104/89; 104/249

(58) Field of Classification Search
USPC ..... 182/12, 36, 39; 104/249, 250, 89, 90, 104/91, 140; 212/76, 86, 90, 93, 94, 116, 212/336, 337
See application file for complete search history.

(56) References Cited

U.S. PATENT DOCUMENTS

| | | | | |
|---|---|---|---|---|
| 308,444 | A * | 11/1884 | Terwilliger | 182/82 |
| 4,267,900 | A * | 5/1981 | Yin-Lung | 182/13 |
| 7,175,534 | B2 * | 2/2007 | Liggett | 472/15 |

* cited by examiner

*Primary Examiner* — Charles A Fox
*Assistant Examiner* — Kristine Florio
(74) *Attorney, Agent, or Firm* — Robert SayFie

(57) ABSTRACT

A track having a stopping means that can stop a puck member from descending an undesired distance. After stopping of the puck member, the user can relocate the puck member within a channel for continued downward movement within the channel.

14 Claims, 4 Drawing Sheets

Detail B

Section A-A

TRACK WITH STOPPING MEANS

FIELD OF THE INVENTION

This invention relates to an apparatus that allows a user to move or be displaced in from one location to another along a track having a channel.

BACKGROUND OF THE INVENTION

Challenge courses are structures that allow a person or team to challenge themselves by participating in various events such as walking along swinging ropes or planks, at elevated heights. These courses are also used to train military personnel. These courses are also used at recreational parks or other such centers that have go-carts and miniature golf.

Zip lines are generally ropes or cables that are connected at both ends to fixed members of varying heights. In other words, one end is higher than the other. A participant then, by use of a pulley that rotatably engages with the rope or cable, glides from the higher end to the lower end.

The present invention is a track that has a channel configured to slow or stop a moveable member as it reaches a certain area of the track. The user then has to move a puck from its current position, so it can then slide with respect to the track, until, if, another stopping means is encountered. This prevents someone from falling downwardly into the person adjacent to them. This also prevents someone from sliding down the track.

This differs from the prior art in that it there is no way to prevent the puck from sliding down the track from top to bottom uninhibited.

There exists a need for a means to prevent a puck from sliding uninhibited downwardly in the track.

There also exists the need to prevent someone to fall into the person adjacent to them.

Multiple embodiments of the system are disclosed herein. It will be understood that other objects and purposes of the invention, and variations thereof, will be apparent upon reading the following specification and inspecting the accompanying drawings.

REFERENCE NUMERALS LIST

10 challenge course
20 element track
30 track with stopping means
40 stairs
50 channel
60 stopping means
70 first side
80 second side
90 first side first angle
100 second side first angle
110 first side second angle
120 second side second angle
140 second side third angle
150 rightwardly angled stopping means
160 leftwardly angled stopping means
170 puck
180 puck member
190 user
200 harness
210 track inside
220 interface
230 downward direction

SUMMARY OF THE INVENTION

One aspect of the present invention is a track with stopping means 30, comprising: the track with stopping means 30 having a first side 70, and an opposed second side 80 to define a channel 50; said first side 70 connected to a first side first angle 90 that extends rightwardly about 24 degrees for about 2.46 inches and connect to a first side second angle 110 that is substantially parallel to said first side 70; said second side 80 connected to a second side first angle 100 that extends rightwardly about 12.5 degrees for about 2.3 inches to a second side second angle 120 that is substantially perpendicular to said second side 80; said second side second angle 120 extends about ½ inch to a second side third angle 140 that is substantially parallel to said second side; an interface 220 where said second side first angle 100 connects to said second side second angle 120.

Another aspect of the present invention is a track with stopping means 30, comprising: the track with stopping means 30 having a first side 70, and an opposed second side 80 to define a channel 50; said first side 70 connected to a first side first angle 90 that extends leftwardly about 24 degrees for about 2.46 inches and connect to a first side second angle 110 that is substantially parallel to said first side 70; said second side 80 connected to a second side first angle 100 that extends leftwardly about 12.5 degrees for about 2.3 inches to a second side second angle 120 that is substantially perpendicular to said second side 80; said second side second angle 120 extends about ½ inch to a second side third angle 140 that is substantially parallel to said second side; an interface 220 where said second side first angle 100 connects to said second side second angle 120.

These and other features, aspects and advantages of the present invention will become better understood with reference to the following drawings, description and claims.

DETAILED DESCRIPTION OF THE INVENTION

Figure 1:
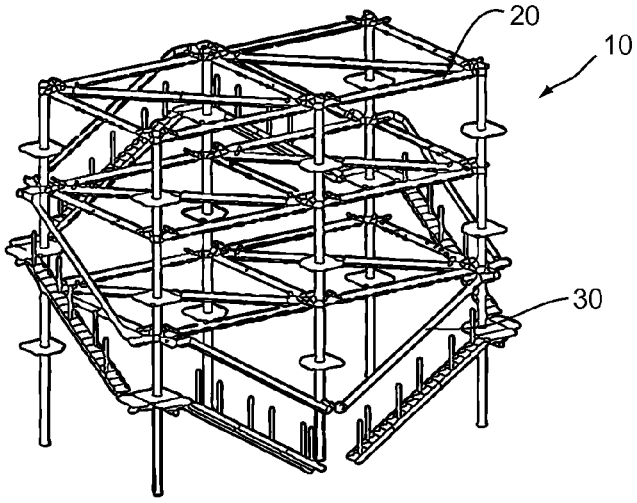
FIG. 1 is a pictorial view of one embodiment of the present invention used with a challenge course.

The following detailed description is of the best currently contemplated modes of carrying out the invention. The description is not to be taken in a limiting sense, but is made merely for the purpose of illustrating the general principles of the invention, since the scope of the invention is best defined by the appended claims.

Certain terminology will be used in the following description for convenience and reference only, and will not be limiting. For example, the words "upwardly," "downwardly," "rightwardly," and "leftwardly" will refer to directions in the drawings to which reference is made. The words "inwardly" and "outwardly" will refer to directions toward and away from, respectively, the geometric center of the system and designated parts. Said terminology will include the words specifically mentioned, derivatives, and similar words. Also, "connected to," "secured to," or similar language includes the definitions "indirectly connected to," "directly connected to," "indirectly secured to," and "directly secured to."

FIG. 1 illustrates a challenge course 10 that can utilize the present inventions, titled track with stopping means 30. The track with stopping means 30 may have a differently configured channel 50 than a typical element track 20.

Figure 2:
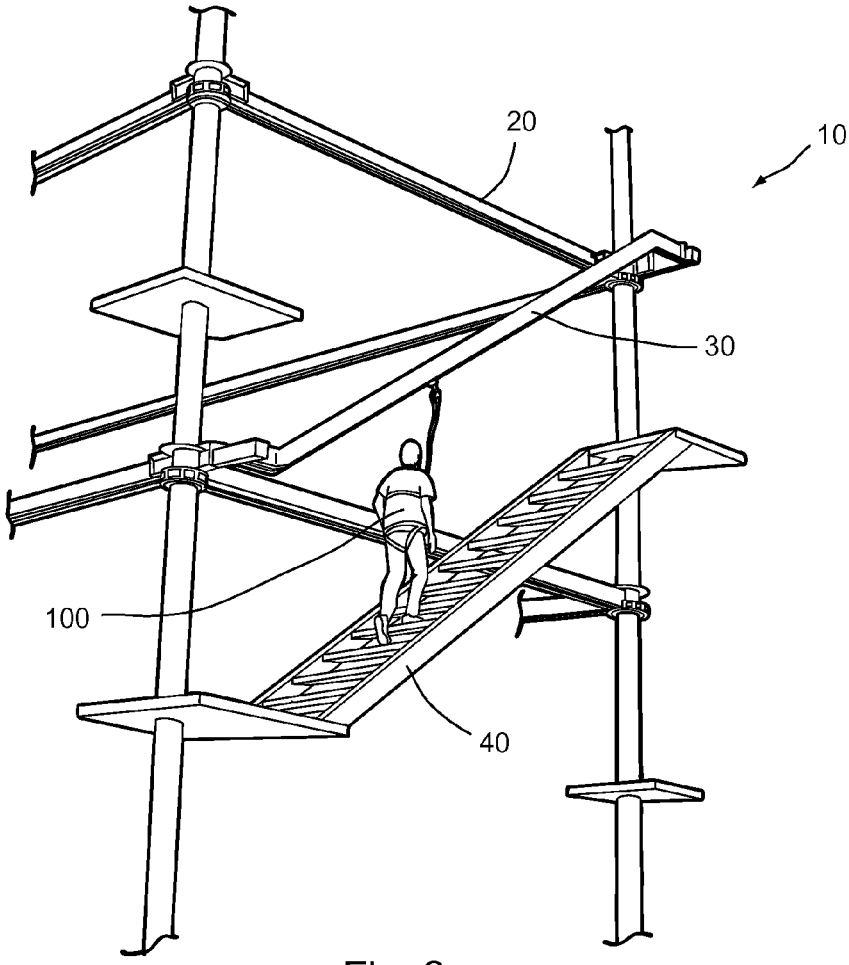
FIG. 2 is a pictorial view of one embodiment of the present invention used above a stairway.

FIG. 2 illustrates an embodiment of the track with stopping means 30 secured above a stairway 40. When above a stairway, if the user 190 falls or slips, then a puck member 180 that may descend until it encounters a stopping means 60, at which point it would stop, preventing the user from further falling.

Figure 3:
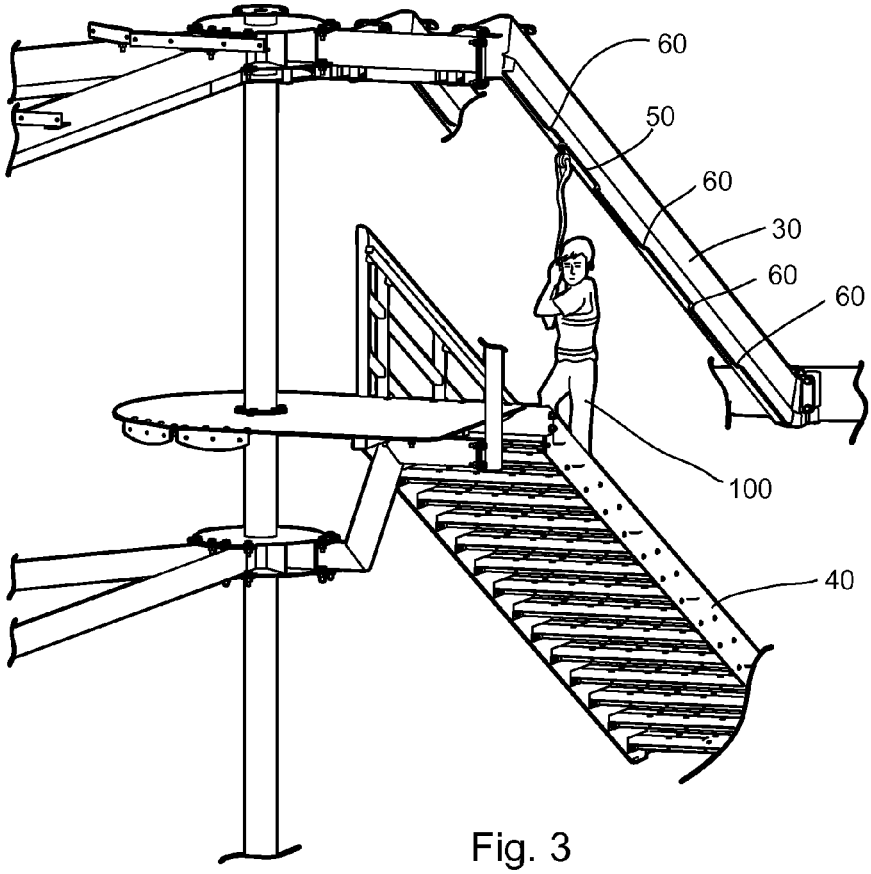
FIG. 3 is another pictorial view of one embodiment of the present used above a stairway.

FIG. 3 illustrates a one embodiment of track with stopping means 30 and a stopping means 60.

Figure 4:
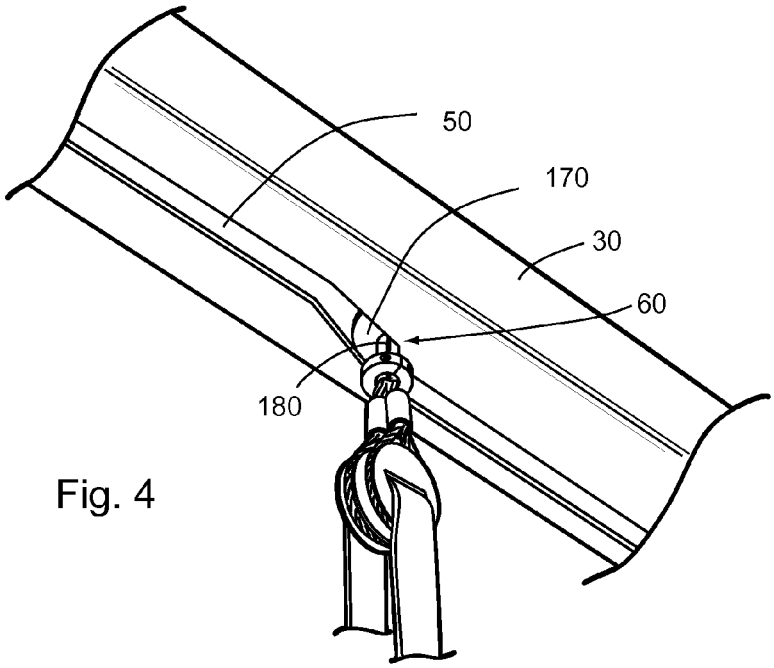
FIG. 4 is a pictorial view of a puck member stopped by the stopping means.

FIG. 4 illustrates an embodiment of the stopping means 60. The puck 170 may be movably disposed within the track with stopping means 30. In one embodiment the puck 170 may have a puck member 180 descending therefrom, downwardly to be connected, directly, or indirectly to a harness worn by the user 190. In FIG. 4, the puck member 180 is stopped by the stopping means 60.

Figure 5:
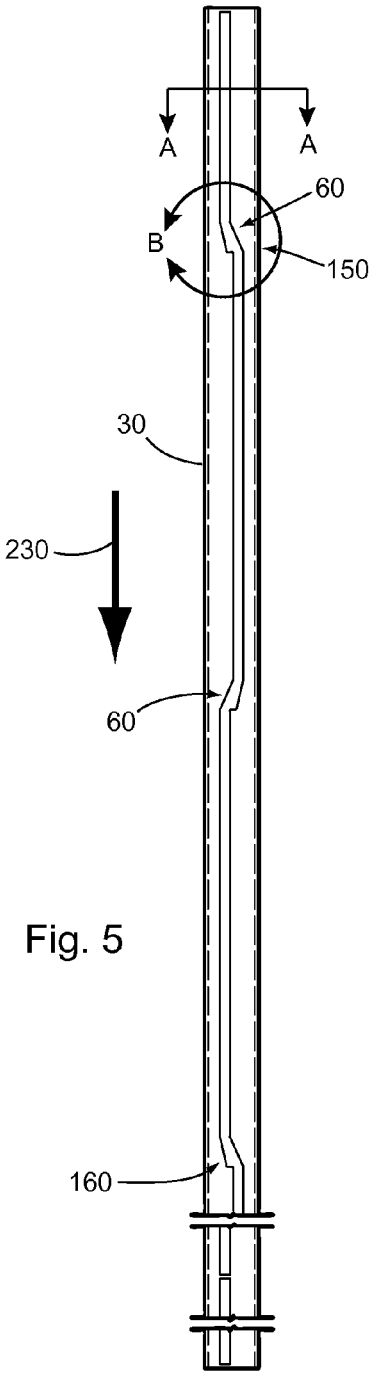
FIG. 5 is a pictorial view of an embodiment of the channel, stopping means, rightwardly angled stopping means, and leftwardly angled stopping means.

FIG. 5 illustrates an embodiment of a track with stopping means 30. Three stopping means 60 are shown in FIG. 5.

Figure 6:
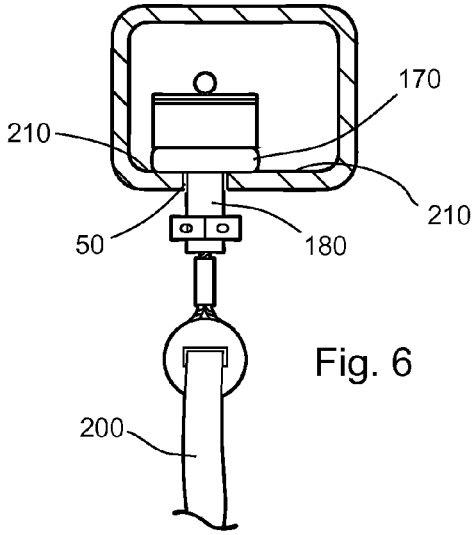
FIG. 6 is a cross sectional view of FIG. 5.

FIG. 6 illustrates a cross section of FIG. 5. The puck 170 may be movably displaced in the track with stopping means 30 upwardly from the channel 50. A puck member 180 may extend downwardly through the channel 50 to a harness 200 that may be connected to a user 190.

Figure 7:
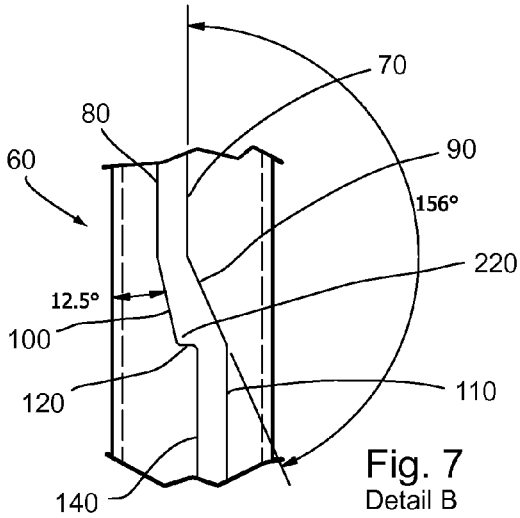
FIG. 7 is a sectional view of the line B-B of FIG. 5.

FIG. 7 illustrates the stopping means 60. The stopping means 60 may be integral with a standard channel having a first side 70 and a second side 80. The first side 70 may extend to a first side first angle 90 about 24 degrees to the right at a distance of about 2.46 inches. The first side first angle 90 may then extend to a first side second angle 110 that is substantially parallel to the first side 70.

The second side 80 may extend to a second side first angle 100 about 12.5 degrees to the right at a distance of about 2.3 inches. The second side first angle 100 may extend toward the first side first angle 90 to a second side second angle 120 that is substantially perpendicular to the second side 80 for a distance of about ½ of an inch. The junction of the second side first angle 100 with the second side second angle 120 may have a radius of about ⅛ of an inch.

The second side second angle 120 may extend to a second side third angle 140 that may be substantially parallel to the second side 80.

Generally, there the space between the second side 80 and the first side 70 defines the channel 50, and the width of the channel may be about ¾ of an inch.

The present invention 30 may have a stopping means 60 disposed about 2 feet away from an adjacent stopping means 60. The stopping means 60 may be configured as a mirror image of any adjacent stopping means 60.

For example, the stopping means 60 adjacent to the above described stopping means 60 may have a first side 70 and a second side 80. The first side 70 may extend to a first side first angle 90 about 24 degrees to the left at a distance of about 2.46 inches. The first side first angle 90 may then extend to a first side second angle 110 that is substantially parallel to the first side 70.

The second side 80 may extend to a second side first angle 100 about 12.5 degrees to the left at a distance of about 2.3 inches. The second side first angle 100 may extend inwardly to a second side second angle 120 that is substantially perpendicular to the second side 80 for a distance of about ½ of an inch. The junction of the second side first angle 100 with the second side second angle 120 may have a radius of about ⅛ of an inch.

The second side second angle 120 may extend to a second side third angle 140 that may be substantially parallel to the second side 80.

The adjacent or downstream stopping means 60 may be arranged in alternating mirror image fashion, but do not have to be.

If a user 190 starts to fall or if the puck member 180 is displaced in the downward direction 230, then the user puck 170 may slide down the track inside 210 until the puck member 180 contacts the second side second angle 120, which stops the puck member 180. The user 190 may then move the puck member 180 off of the second side second angle 120 or away from the second side first angle 100 to allow the puck member 180 to move between the first side 70 and the second side 80, or move within the channel 50.

If a user 190 and puck member 180 is moving in the direction opposite of the downward direction 230 then the puck member 180 would contact the first side first angle 90 and continue to move within the channel 50 without stopping because the puck member 180 would not contact the second side second angle 120, which causes to stop the puck member 180.

In one embodiment, the puck member 180 may have a diameter of about 0.575 inches. In another embodiment the puck member 180 may have a diameter of about 0.580 inches.

Figure 8:
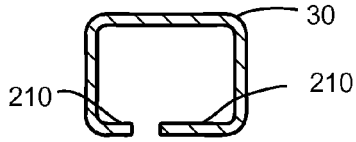
FIG. 8 is a sectional view of the line A-A of FIG. 5.

FIG. 8 illustrates a sectional view of the track with stopping means 30.

Figure 9:
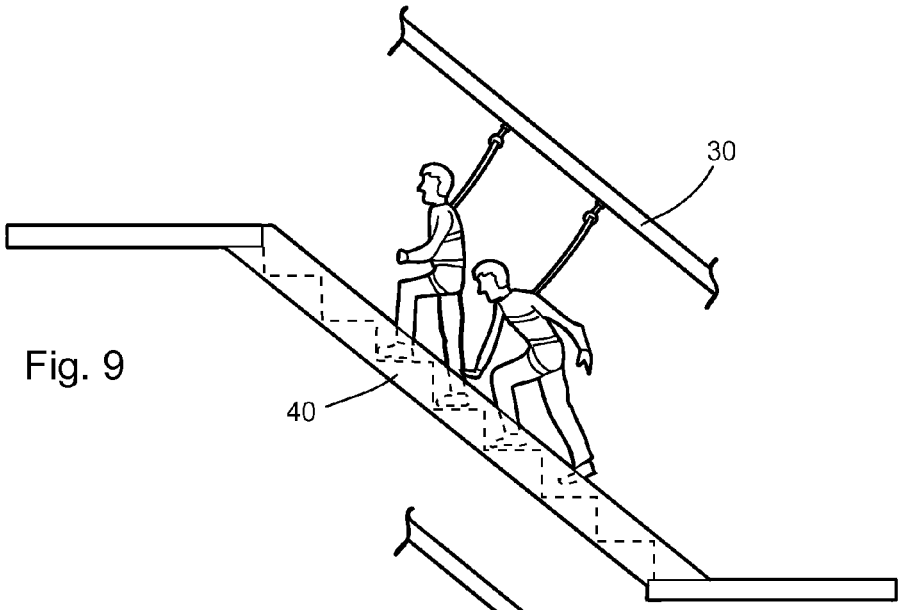
FIG. 9 is a pictorial showing two users ascending a stairway using the track with stopping means.

FIG. 9 illustrates an example of two users 190 walking upwardly on a staircase or stairs 40, if the second user falls, the stopping means 60 will prevent him from descending all the way down to the bottom of the stairs 40.

Figure 10:
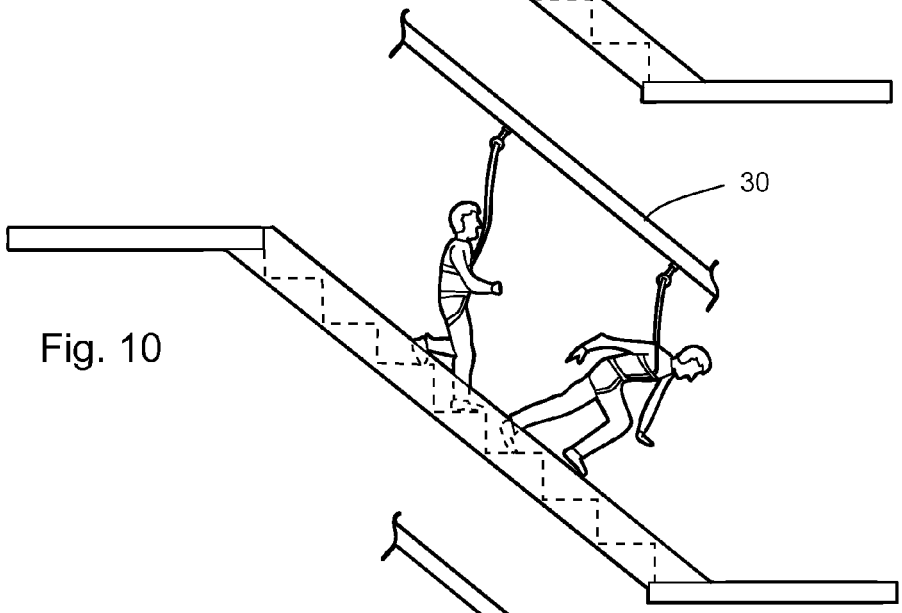
FIG. 10 is a pictorial showing two users descending a stairway using the track with stopping means.

FIG. 10 illustrates an example of two users 190 descending a stairway 40 with one user 190 falling, as the stopping means 60 prevents them from sliding down to the bottom of the stairs 40. If the user would slide to the bottom of the stairs 40, the user 190 may have reached a speed that would result in a greater force to stop the user 190, and thus greater force for the user 190 to endure.

Figure 11:
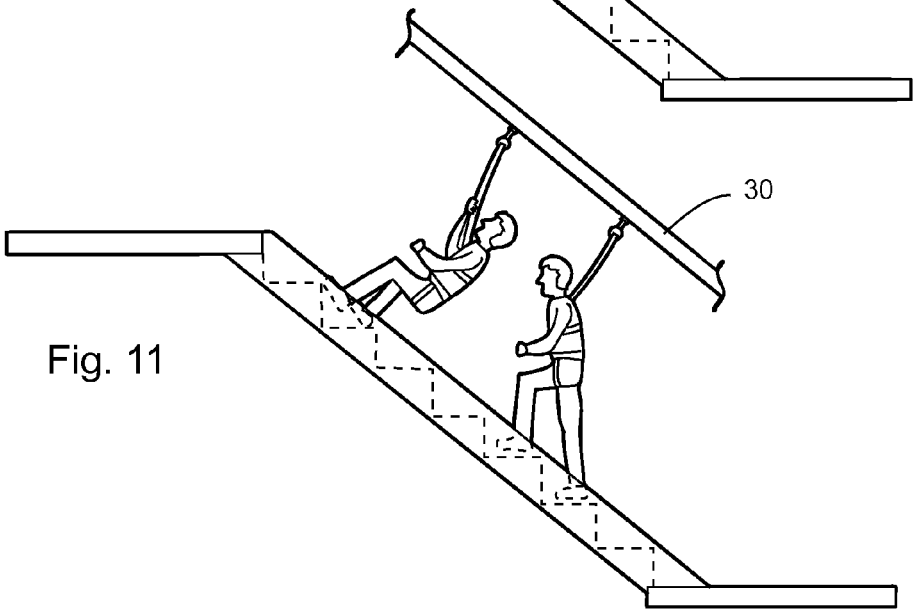
FIG. 11 is a pictorial showing two users ascending a stairway using the track with stopping means.

FIG. 11 illustrates two users 190 ascending stairs 40, with the first user 190 falling, and not falling into the lower user 190 because the stopping means 60 stops the puck member 180 at the junction or interface between the first side first angle 110 and the second side second angle 120.

The track with stopping means 30 may be connected to a challenge course or an element track 20, so the puck 170 may move from the track with stopping means 30 to a challenge course track, or an element track 20, or a zip line.

It should be understood, of course, that the foregoing relates to exemplary embodiments of the invention and that modifications may be made without departing from the spirit and scope of the invention as set forth in the following claims.

We claim:

1. A track with stopping means (30), comprising:

the track with stopping means (30) being oriented in a substantially non-vertical orientation having a first side (70), and an opposed second side (80) to define a channel (50);

said first side (70) connected to a first side first angle (90) that extends rightwardly about 24 degrees from a plane coincident with said first side (70) for about 2.46 inches and connects to a first side second angle (110) that is substantially parallel to said first side (70);

said second side (80) connected to a second side first angle (100) that extends rightwardly about 12.5 degrees from a plane coincident with said second side (80) for about 2.3 inches to a second side second angle (120) that is substantially perpendicular to said second side (80); said second side second angle (120) extends about ½ inch to a second side third angle (140) that is substantially parallel to said second side; an interface (220) where said second side first angle (100) connects to said second side second angle (120); said first side first angle (90) directly across said channel (50) from said second side first angle (100), and said second side second angle (120) directly across said channel (50) from said first side first angle (90).

2. The apparatus of claim 1, wherein the interface (220) has a radius of about ⅛ of an inch.

3. The apparatus of claim 1, further comprising:

said track with stopping means (30) connected to an element track (20).

4. The apparatus of claim 1, wherein the channel (50) is about ¾ inch wide.

5. The apparatus of claim 1, wherein a puck member (180) is movably disposed within said channel (50).

6. The apparatus of claim 5, wherein said puck member (180) has a diameter of about 0.578 inches.

7. The apparatus of claim 1, whereby the track with stopping means (30) has a plurality of stopping means (60) spaced about 2 feet apart.

8. A track with stopping means (30), comprising:

the track being disposed in a substantially non-vertical orientation with stopping means (30) having a first side (70), and an opposed second side (80) to define a channel (50);

said first side (70) connected to a first side first angle (90) that extends leftwardly about 24 degrees from a plane coincident with said first side (70) for about 2.46 inches and connect to a first side second angle (110) that is substantially parallel to said first side (70);

said second side (80) connected to a second side first angle (100) that extends leftwardly about 12.5 degrees from a plane coincident with said second side (80) for about 2.3 inches to a second side second angle (120) that is substantially perpendicular to said second side (80); said second side second angle (120) extends about ½ inch to a second side third angle (140) that is substantially parallel to said second side; an interface (220) where said second side first angle (100) connects to said second side second angle (120), said first side first angle (90) directly across said channel (50) from said second side first angle (100), and said second side second angle (120) directly across said channel (50) from said first side first angle (90).

9. The apparatus of claim 8, wherein the interface (220) has a radius of about ⅛ of an inch.

10. The apparatus of claim 8, further comprising:

Said track with stopping means (30) connected to an element track (20).

11. The apparatus of claim 8, wherein the channel (50) is about ¾ inch wide.

12. The apparatus of claim 8, wherein a puck member (180) is movably disposed within said channel (50).

13. The apparatus of claim 12, wherein said puck member (180) has a diameter of about 0.578 inches.

14. The apparatus of claim 8, wherein the track with stopping means (30) has a plurality of stopping means spaced about 2 feet apart.

* * * * *